US007088303B1

(12) United States Patent
Lackey et al.

(10) Patent No.: US 7,088,303 B1
(45) Date of Patent: Aug. 8, 2006

(54) FOLDED PATH FLAT-PLATE ANTENNAS FOR SATELLITE COMMUNICATION

(75) Inventors: Raymond J. Lackey, Bohemia, NY (US); Alfred R. Lopez, Commack, NY (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 192 days.

(21) Appl. No.: 10/819,810

(22) Filed: Apr. 7, 2004

(51) Int. Cl.
*H01Q 13/10* (2006.01)

(52) U.S. Cl. ..... 343/771; 343/778

(58) Field of Classification Search ..... 343/771, 343/853, 700 MS, 778
See application file for complete search history.

(56) References Cited

U.S. PATENT DOCUMENTS 5,734,354 A * 3/1998 Twelves ..... 343/815

* cited by examiner

*Primary Examiner*—Michael C. Wimer
(74) *Attorney, Agent, or Firm*—Kenneth P. Robinson

(57) ABSTRACT

Flat-plate antennas have a compact form by use of a folded path network construction whereby received signals are coupled through a unitary network structure to an adjacent signal processing unit. On a folded path basis, processed signals are then coupled back into the network structure, combined with other received processed signals and then passed out of the network structure to an adjacent signal port. The signal processing unit may provide either amplification, phase shifting, or both. By reciprocal operation a signal to be transmitted may be divided into sub-array components, processed (e.g., power amplified and phase shifted), further divided, and coupled to each slot radiating element (e.g., 256 slots) of an array of slot sub-arrays. The unitary network structure may be formed of a stack of aluminum layers or plates, each having openings formed therein so that when the plates are stacked together normal and transverse waveguide sections are formed internally in an arrangement to provide signal coupling, combining and dividing. Methods employing folded path processing are also disclosed.

24 Claims, 12 Drawing Sheets

FOLDED PATH FLAT-PLATE ANTENNAS FOR SATELLITE COMMUNICATION

A variety of forms of antennas have been proposed for point-to-point communication via satellite. In such applications, a radio frequency signal is transmitted from a first antenna providing a beam directed at a satellite, the satellite acts as a repeater re-transmitting received signals, and a second antenna directed at the satellite receives a signal replicating the signal as transmitted from the first antenna. The sequence may be reversed to enable reception at the first antenna of a signal representative of a signal transmitted from the second antenna, to provide two-way communication.

In a form of satellite communication system (referred to generally as a SATCOM system), a series of satellites may be maintained in fixed (GEO) synchronous orbit above the equator, with the satellites in spaced positions along an arc within an equatorial plane. The MILSTAR system is an example of such a system. MILSTAR is a military satellite communication system. Its GEO synchronous satellites transmit at 20 GHz and receive at 45 GHz.

Vehicle-mounted antenna systems suitable for communication via such satellites, while the vehicle is in motion, are subject to a number of constraints. The antenna is desirably of relatively small size, low weight and reasonable cost. Thus, while a two-dimensional fully electronically scannable phased-array type antenna might be considered, cost would generally be prohibitive and low angle (low elevation) scanning would typically be limited. Additional constraints are requirements for adequate antenna gain, with wide beamwidth to enhance signal capture, but with low sidelobe performance. Sidelobe performance can be discrimination between signal transmission/reception characteristics (i.e., antenna patterns) of adjacent satellites to avoid interference during signal reception and transmission from a vehicle.

Generally, known forms of prior antennas have not been capable of meeting all constraints relevant to such usage. However, suitable forms of antenna systems for such usage are described in pending application No. 680,485, titled "Diamond Array Low Sidelobes Flat-Plate Antenna Systems For Satellite Communication", filed Oct. 7, 2003, and having a common assignee with the present application (this application may be referred to as the '485 application). Antenna systems as described in the '485 application, the content of which is hereby incorporated herein by reference, typically include arrays of flat-plate antennas arranged in a diamond array configuration. Antennas as presently described may be particularly adaptable for use both in antenna systems of the type described in the '485 application and in other usages.

Objects of the present invention are to provide new or improved antennas suitable for communication via satellite and antennas providing one or more of the following capabilities or characteristics.

flat plate antenna format;

inclusion of an array of slot radiating elements;

signal combining/dividing via a network structure including a stack of conductive layers;

individual layers including openings forming normal and transverse waveguides when stacked to form a network structure;

folded path signal processing with received signals coupled through the network structure, back into the network structure and then passed out to a signal port;

folded path processing of transmitted signals on a reciprocal basis;

thin construction employing stack of conductive layers;

ultra-thin flat-plate design;

high-reliability mechanical construction;

cost effective design; and compact size.

SUMMARY OF THE INVENTION

In accordance with the invention, an antenna, having conductive layers stacked in a normal dimension with transverse dimensions parallel to the face of the stack, may include:

a top layer having openings forming slot elements arranged in a plurality of sub-arrays;

a plurality of intermediate layers;

a bottom layer having openings forming waveguide sections;

at least a first signal processing unit coupled to at least one of those waveguide sections; and a signal port;

the intermediate layers having openings forming waveguide sections arranged to:

(i) couple signals received via a first sub-array of the slot elements through selected ones of the waveguide sections to the first signal processing unit;

(ii) couple processed signals away from the first signal processing unit through selected ones of the waveguide sections;

(iii) combine the processed signals with processed signals from at least a second sub-array of the slot elements to provide combined signals; and (iv) couple the combined signals through selected ones of the waveguide sections to the signal port.

Also in accordance with the invention, a method, for use with an antenna including a stack of conductive layers each formed with openings usable as waveguie section portions, the layers stacked in a normal dimension with transverse dimensions parallel to the face of the stack, includes the steps of:

(a) coupling received signals in a first normal direction, via a first set of selected openings in at least one of the layers, to a signal processing unit adjacent to the stack to provide processed signals;

(b) coupling the processed signals in a reverse normal direction, via a second set of selected openings in at least one of the layers, from the signal processsing unit to a selected layer within the stack;

(c) coupling the processed signals in a transverse direction, via an opening forming a transverse waveguide section in the selected layer, the transverse waveguide section arranged to combine the processed signals with additional processed signals to provide combined signals; and (d) coupling the combined signals in the first normal direction, via a third set of selected openings in at least one of the layers, to an antenna port.

Further in accordance with the invention, a flat-plate antenna, having nine conductive layers stacked in a normal dimension, with transverse dimensions parallel to the face of the stack, includes:

a first layer (11) having openings forming slot radiating elements arranged in groups (21, 22, 23, 24), the groups arranged in a plurality of sub-arrays (26);

a second layer (12) having openings forming first transverse waveguide sections (28) extending in parallel in a first transverse direction and each coupled to a group of the radiating elements (21, 22, 23, 24);

a third layer (13) having openings forming first normal waveguide sections (30, 31, 32, 33) each coupled to one of the first transverse waveguide sections (28);

a fourth layer (14) having openings forming second transverse waveguide sections (34) extending in parallel in a second transverse direction and each coupled to a plurality of the first normal waveguide sections (30, 31, 32, 33) and thereby coupled to each radiating element of one of the sub-arrays (26);

a fifth layer (15) having openings forming second normal waveguide sections (36, 37) each coupled to one of the second transverse waveguide sections (34, 35);

a sixth layer (16) having openings forming third (38, 39) and fourth (40) transverse waveguide sections, each third transverse waveguide section coupled to one of the second normal waveguide sections (36, 37);

a seventh layer (17) having openings forming third (42, 43), fourth (44, 45) and fifth (52) normal waveguide sections, each third normal waveguide section (42, 43) coupled to a third transverse waveguide section (38, 39) and each fourth and fifth normal waveguide section (44, 45, 52) coupled to a fourth transverse waveguide section (40);

an eighth layer (18) having openings forming extensions (60, 61) of the third normal waveguide sections and extensions (62, 63) of the fourth normal waveguide sections, and forming a fifth transverse waveguide section (66) coupling the fifth normal waveguide sections (51–58) to a common feed point (68);

a ninth layer (19) having openings forming extensions (70, 71) of the third normal waveguide sections and extensions (72, 73) of the fourth normal waveguide sections, and forming sixth normal waveguide section (76) coupled to the common feed point (68); and a support layer (20) suitable to support at least one signal processing unit with coupling access to the third and fourth normal waveguide section extensions (70–73) and to support an antenna port with coupling access to the sixth normal waveguide section (76).

DESCRIPTION OF THE INVENTION

Figure 1:
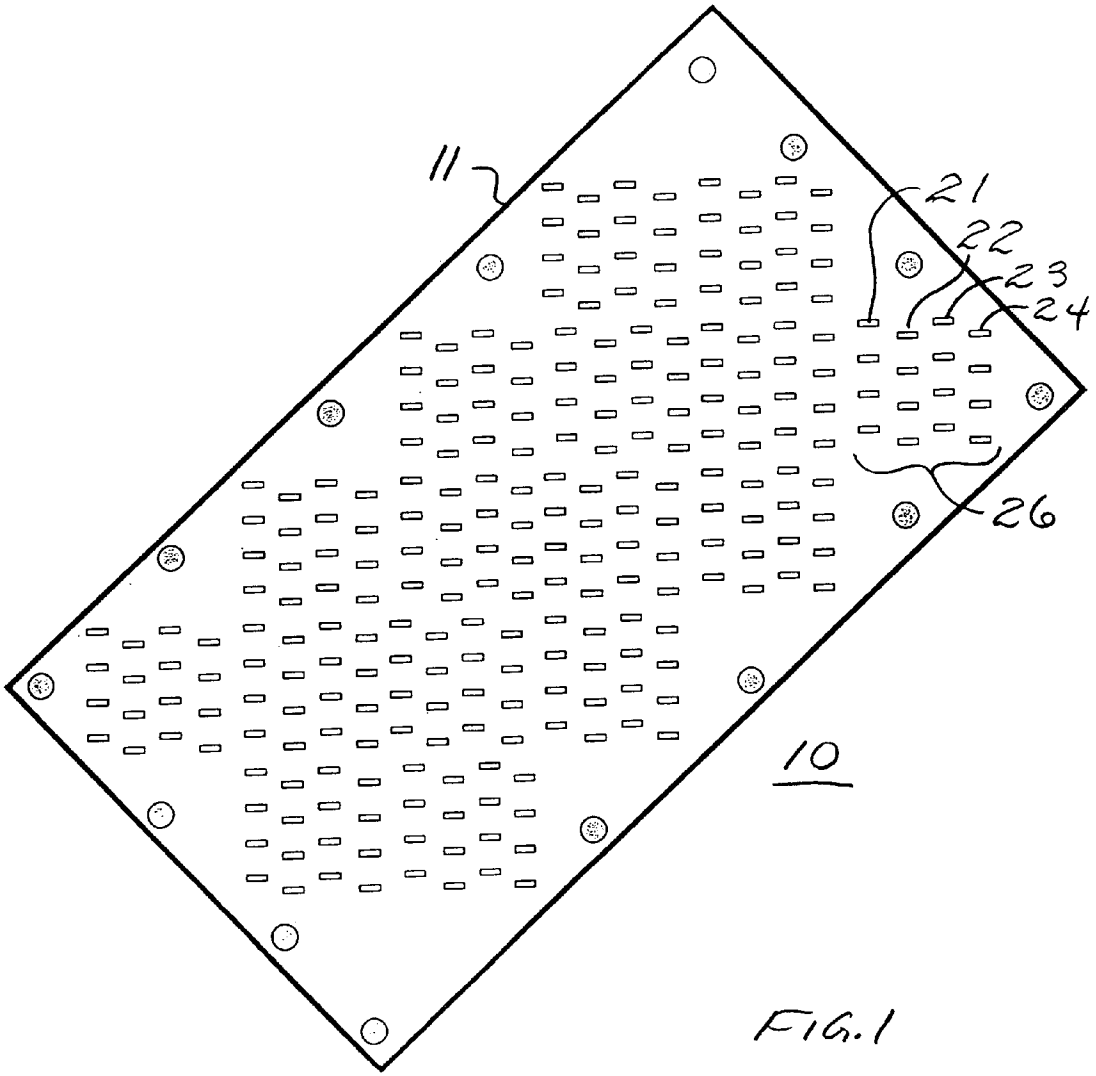
FIG. 1 is a front view of an embodiment of a flat-plate antenna showing slot radiating elements present in the top layer of a stack of nine conductive layers.

FIG. 1 is a front or plan view of a flat-plate antenna having 256 slot radiating elements arranged in sixteen sub-arrays and configured for use in an antenna system to provide communication with a moving vehicle via a satellite, such as satellites of a SATCOM system. Length and width dimensions of an example of a FIG. 1 antenna provided for that application may be approximately 15 inches by 5.8 inches. The basic structure of the antenna may comprise a unitary intercoupling network assembled from a stack of nine conductive layers (e.g., aluminum plate or sheet sections) having openings machined or otherwise formed therein. The height or thickness of the entire stack of nine layers may be of the order of one-half inch. As will be discussed, a support layer (e.g., a form of printed circuit board) may be positioned below the bottom layer (i.e., below the ninth layer) to support one or more signal processing units and a signal port (e.g., input/output port).

In particular applications it may also be desirable to position a polarizer plate or layer above the top layer (i.e., above the first layer). By application of known techniques, such polarizer may be arranged to convert incident circularly polarized signals to linearly polarized signals for coupling to the slot radiating elements visible in FIG. 1. By principles of reciprocal operation, such a polarizer would also be effective to convert linearly polarized signals radiated by the slot elements into circularly polarized signals transmitted to a satellite, for example. In a typical configuration, the total thickness of an antenna including the stack of nine layers, a support layer (e.g., printed circuit board), signal processing units supported by the support layer and a polarizer layer may be of the order of one and one-quarter inches. As will be further described, there is thus made possible essentially a complete antenna providing an array of slot radiating elements and incorporating a signal processing configuration while having an overall thickness which makes the antenna particularly suitable for use in various moving vehicle to satellite communication applications.

More particularly, FIG. 1 provides a front view of the top layer 11 of a flat-plate antenna 10 comprising nine conductive layers stacked in a normal dimension, with transverse dimensions parallel to the face of the stack. Thus, in FIG. 1 the normal dimension is perpendicular to the drawing page and the length and width dimensions are transverse directions. As shown in FIG. 1, first layer 11 has openings forming slot radiating elements arranged in groups (e.g., group 21, 22, 23, 24) with the groups arranged in a plurality of sub-arrays (e.g., sub-array 26). As shown, in this implementation each group includes four slot radiating elements, each sub-array includes four groups for a total of sixteen slot radiating elements, and the antenna 10 includes sixteen sub-arrays for a total of 256 slot radiating elements. The circular shapes near the edges of layer 11 represent provision for fastening devices for fixing the nine layers in place mechanically.

Figure 2:
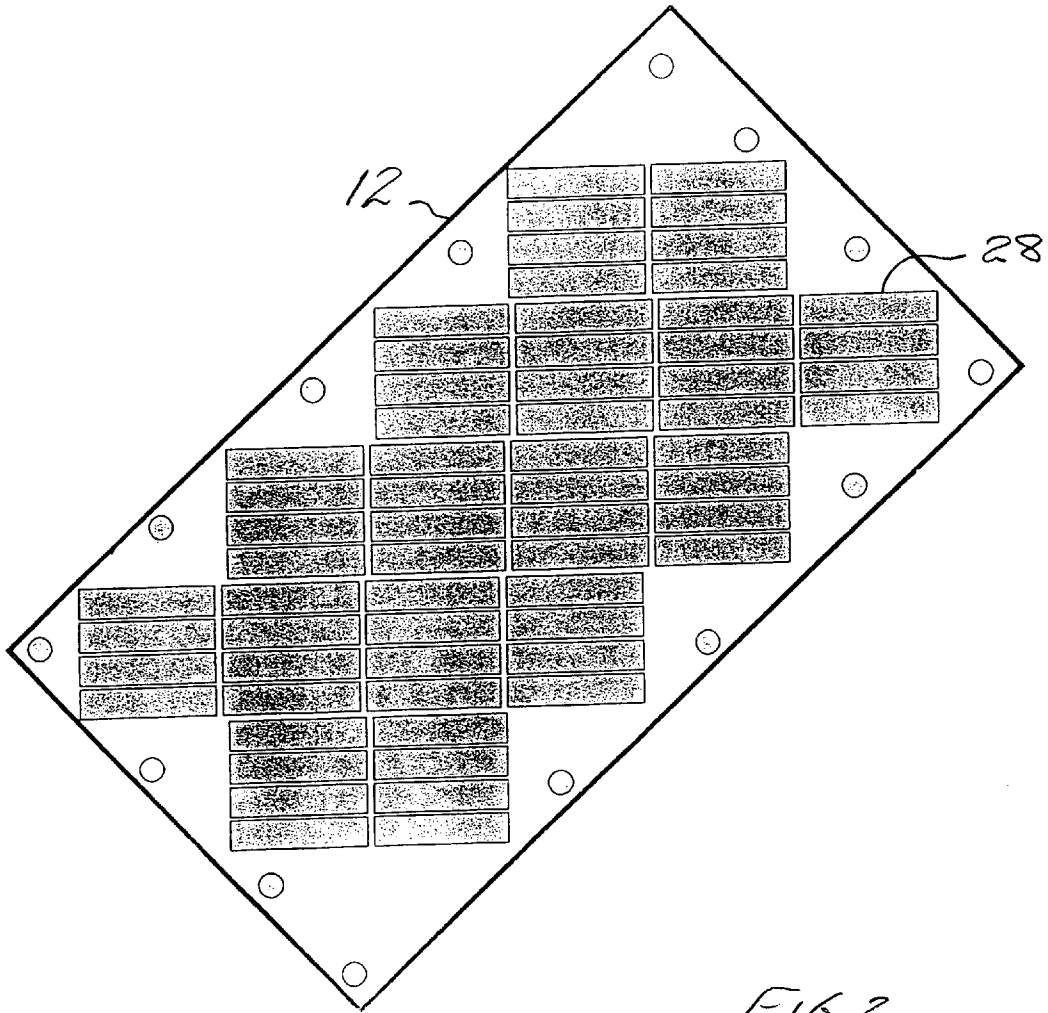
FIGS. 2, 3, 4, 5, 6, 7, 8 and 9 are top views of the remaining eight layers, which have openings forming waveguide sections.

Second layer 12, as shown in FIG. 2 has openings forming first transverse waveguide sections (e.g., waveguide section 28) extending in parallel in a first transverse direction (i.e., group 21, 22, 23, 24 extending in a horizontal direction in FIG. 2). The four slot elements 21, 22, 23, 24 extend through layer 11 and thus the lower end of each slot element is positioned immediately above the transverse waveguide section 28. Element 28 in layer 12 will be referred to as a waveguide section, although physically it is merely a rectangular opening in layer 12. Element 28 becomes a waveguide when top and bottom walls are provided by adjacent portions of layers 11 and 13 when the layers are stacked as described. With this construction, during antenna use signals received via each of slot elements 21, 22, 23, 24 will be coupled to and added together within transverse waveguide section 28 to form a composite signal. Composite signals within transverse waveguide section 28 can then be coupled out of layer 12 via a normal waveguide section 30 as will be discussed with reference to layer 13.

Figure 3:
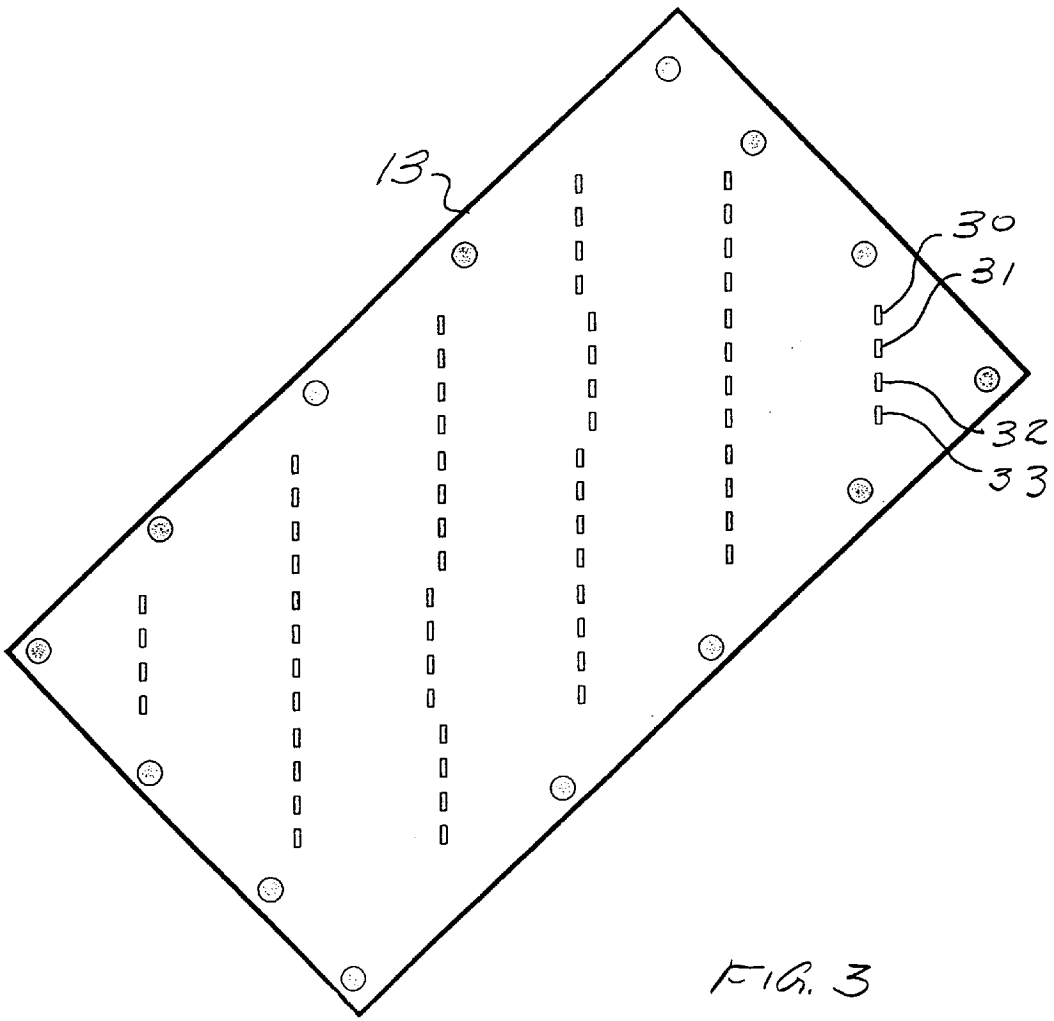

Third layer 13, as shown in FIG. 3 has openings forming first normal waveguide sections (e.g., waveguide sections 30, 31, 32, 33) each of which is coupled to one of the first transverse waveguide sections. Thus, first normal waveguide section 30 is coupled to first transverse waveguide section 28 when the layers are positioned in a stack as described. As a result, signals received via slot elements 21, 22, 23, 24 would, after being combined in transverse waveguide section 28, then be coupled to fourth layer 14 via first normal waveguide section 30, as will be described. Similarly, signals received via the three other groups of slot elements included in sub-array 26 in FIG. 1 would be coupled via first normal waveguide sections 31, 32, 33 to layer 14.

Figure 4:
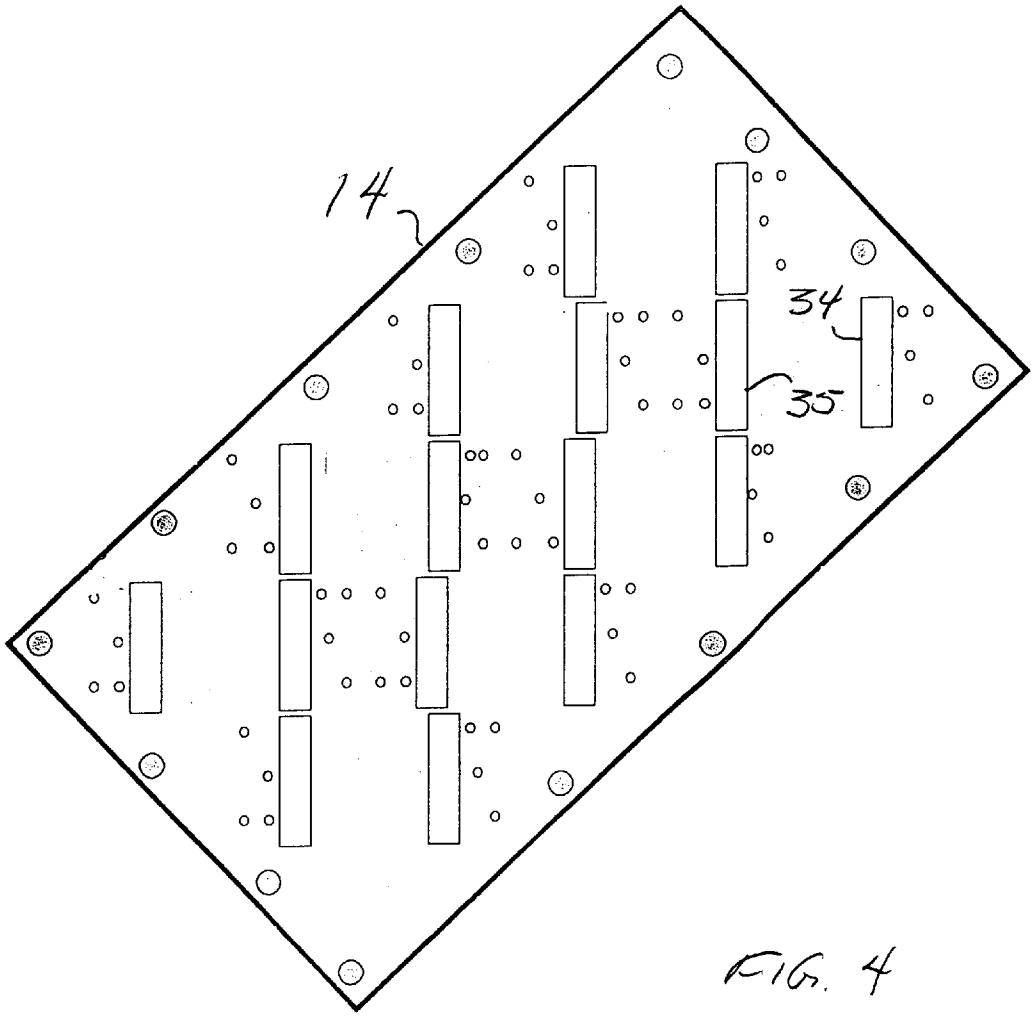

Fourth layer 14, as shown in FIG. 4 has openings forming second transverse waveguide sections (e.g., waveguide section 34) extending in parallel in a second transverse direction (i.e., extending in a vertical direction in FIG. 4) and each coupled to a plurality of the first normal waveguide sections. Thus, second transverse waveguide section 34 is coupled to first normal waveguide sections 30,31, 32, 33 and thereby coupled to each of the sixteen slot radiating elements of one of the sub-arrays identified as sub-array 26 in FIG. 1. Similarly, second transverse waveguide section 35 is coupled to each of the sixteen slot radiating elements of the sub-array appearing immediately to the left of sub-array 26 in FIG. 1. Small circular shapes included in FIG. 4 represent provision for fastening signal processing unit 90 to the mechanical assembly of layers included in the antenna.

Figure 5:
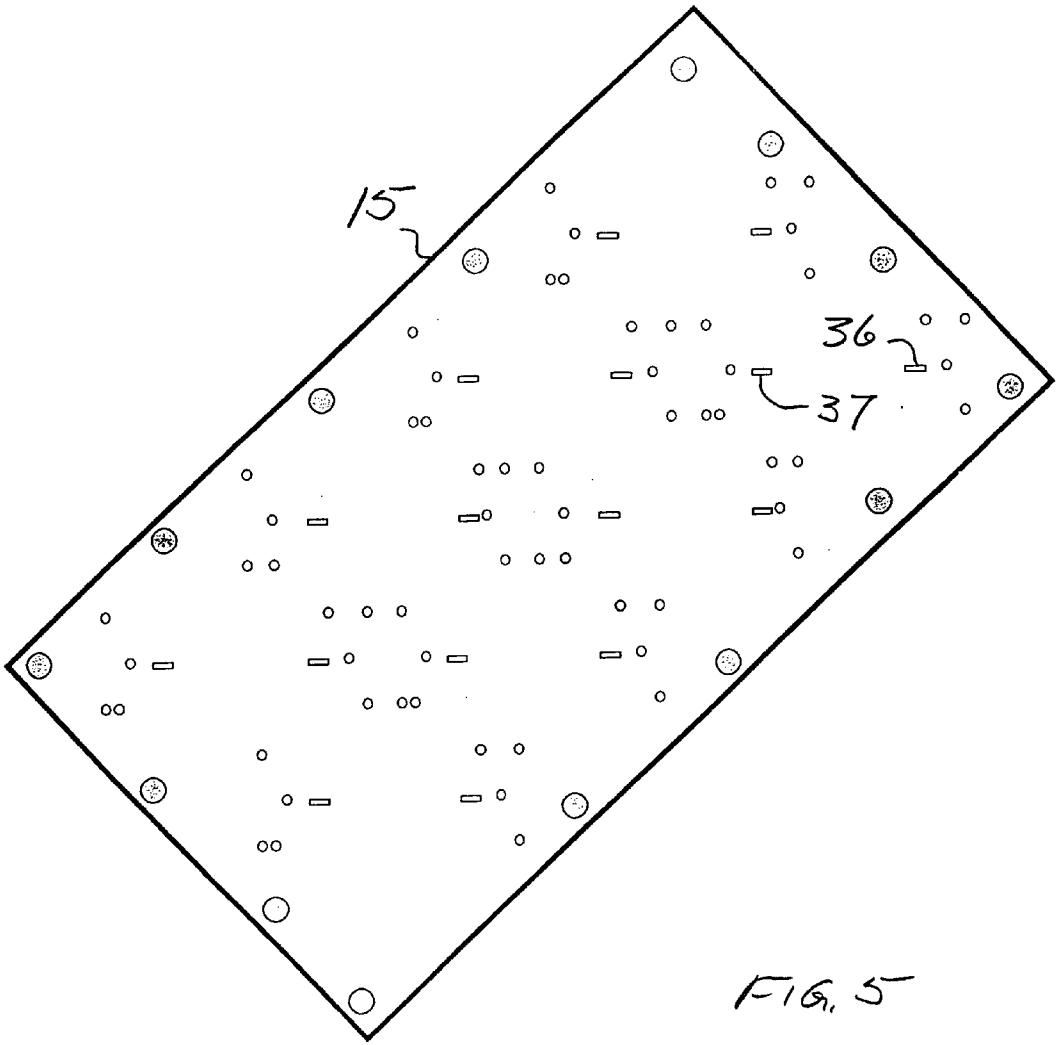

Fifth layer 15, as shown in FIG. 5 has openings forming second normal waveguide sections (e.g., waveguide section 36) extending in a normal direction through layer 15 and each coupled to one of the second transverse waveguide sections (e.g., waveguide section 34). Thus, individual second normal waveguides 36 and 37 of layer 15 are respectively coupled to second transverse waveguide sections 34 and 35 of layer 14. The remaining second normal waveguides of layer 15 are each respectively coupled to one of the remaining fourteen second normal waveguides of layer 14.

Figure 6:
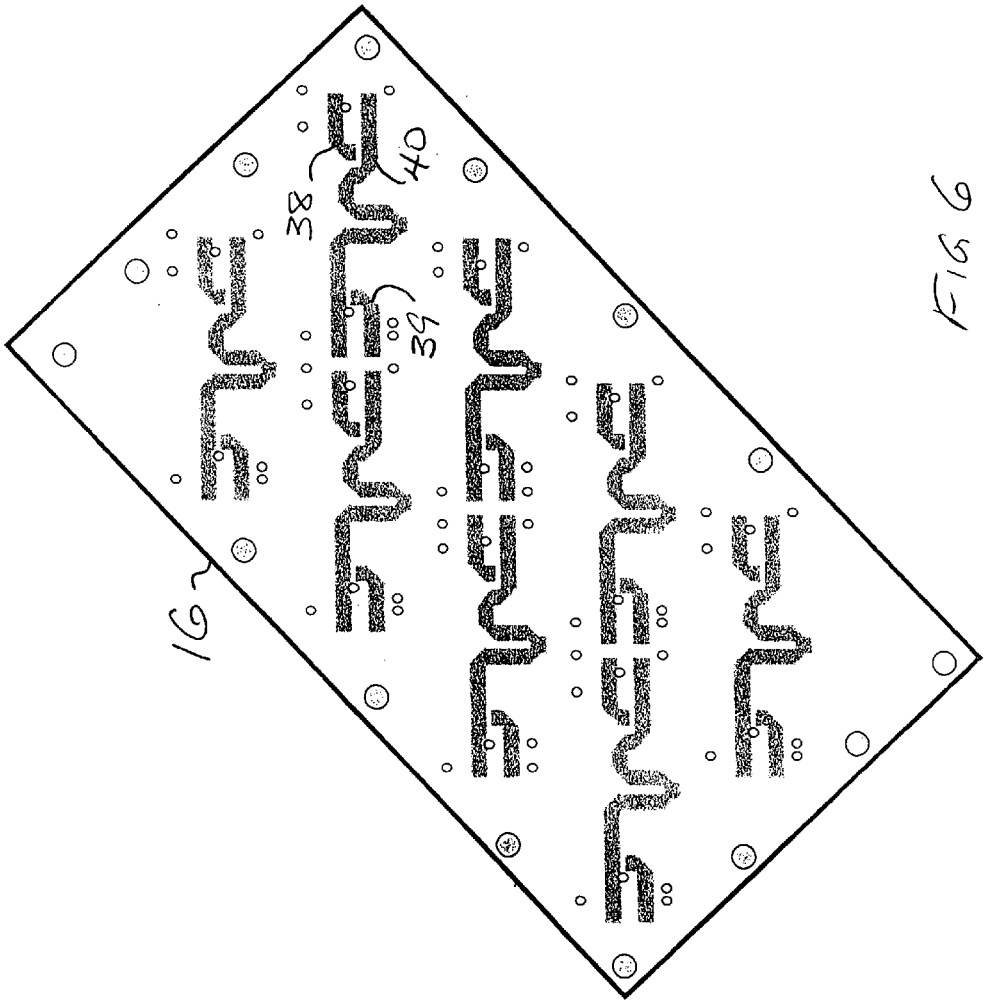

Sixth layer 16, as shown in FIG. 6 has openings forming third (e.g., transverse waveguide sections 38 and 39) and fourth (e.g., transverse waveguide section 40) transverse waveguide sections. Each of the third transverse waveguide sections 38 and 39 is coupled to a respective one of the second normal waveguide sections 36 and 37. Coupling to fourth transverse waveguide section 40 will be described below. The drawings are provided for illustrative purposes and are not necessarily to scale or fully dimensionally accurate. Thus, some of the small circular shapes (e.g., assembly holes) in FIG. 6 impinge upon transverse waveguide sections, but would not so impinge in an actual antenna, unless provided for in a particular design.

Figure 7:
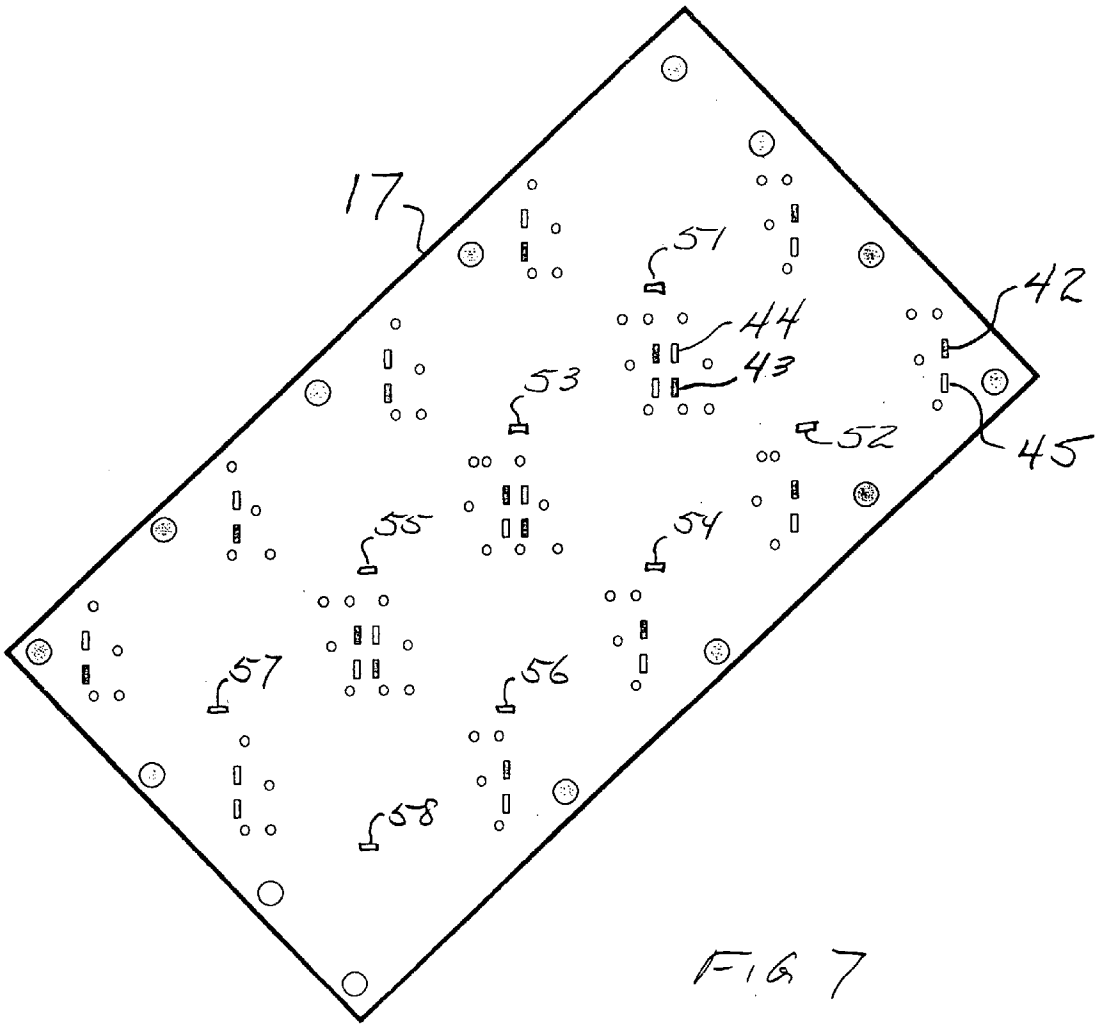

Seventh layer 17, as shown in FIG. 7 has openings forming third (e.g., normal waveguide sections 42 and 43), fourth (e.g., normal waveguide sections 44 and 45) and fifth (e.g., normal waveguide section 52) normal waveguide sections. Each of the third normal waveguide sections 42 and 43 is coupled to a respective one of the third transverse waveguide sections 38 and 39 at a location remote from the couplings to the second normal waveguide sections 36 and 37 referred to above. Each of the fourth and fifth normal waveguide sections 44,45 and 52 of layer are coupled to fourth transverse waveguide section 40 of layer 6. In this configuration, fourth normal waveguide sections 44 and 45 are coupled to opposite ends of fourth transverse waveguide section 40 and fifth transverse waveguide section 52 is coupled to the waveguide section 40 at an intermediate location.

Actual signal flow between waveguide sections 44 and 45 and waveguide section 40, and between waveguide section 52 and waveguide section 40, comprises folded path signal flow and will be described in greater detail below. As shown, layer 17 of FIG. 7 includes eight of the fifth normal waveguide sections 51–58 arranged so that during signal reception each is effective to couple to layer 18 combined signals as received via two of the sixteen sub-arrays of slot elements of FIG. 1. Thus, as will be further described the combination of eight of the fifth normal waveguide sections 51–58 is effective to couple signals received via all 16 sub-arrays and thereby all 256 slot elements to layer 18 for further processing.

Figure 8:
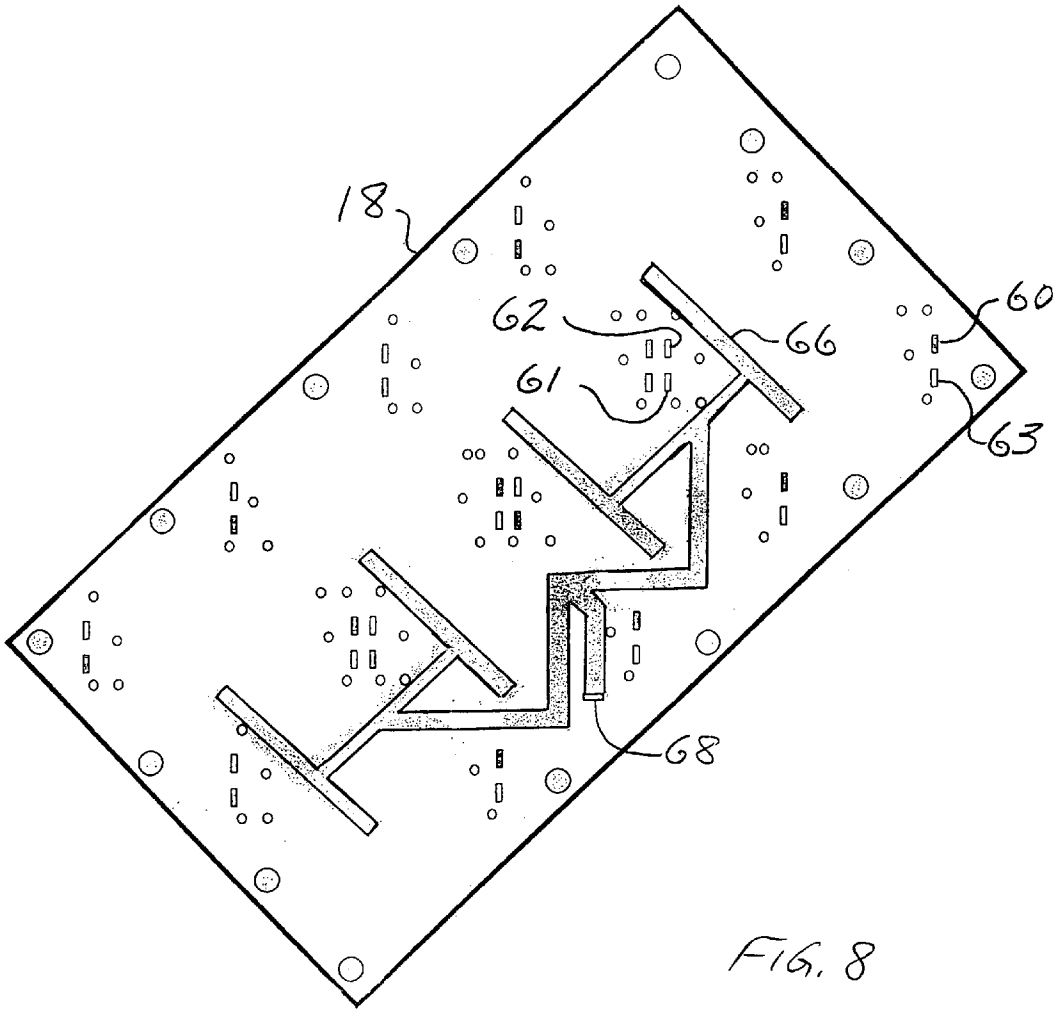

Eighth layer 18, as shown in FIG. 8 has openings forming extensions (e.g., normal waveguide extensions 60 and 61) of third normal waveguide sections (e.g., of normal sections 42 and 43, respectively) and extensions (e.g., normal waveguide extensions 62 and 63) of fourth normal waveguide sections (e.g., of normal sections 44 and 45, respectively) of layer 17. Eighth layer 18 further includes an opening forming a fifth transverse waveguide section 66 configured to provide coupling of all of the fifth normal waveguide sections 51–58 to a common feed point 68. Fifth transverse waveguide section 66 is thus configured to couple received signals from all 16 sub-arrays, and therefore from all 256 slot elements, of FIG. 1 to layer 19, via common feed point 68.

Figure 9:
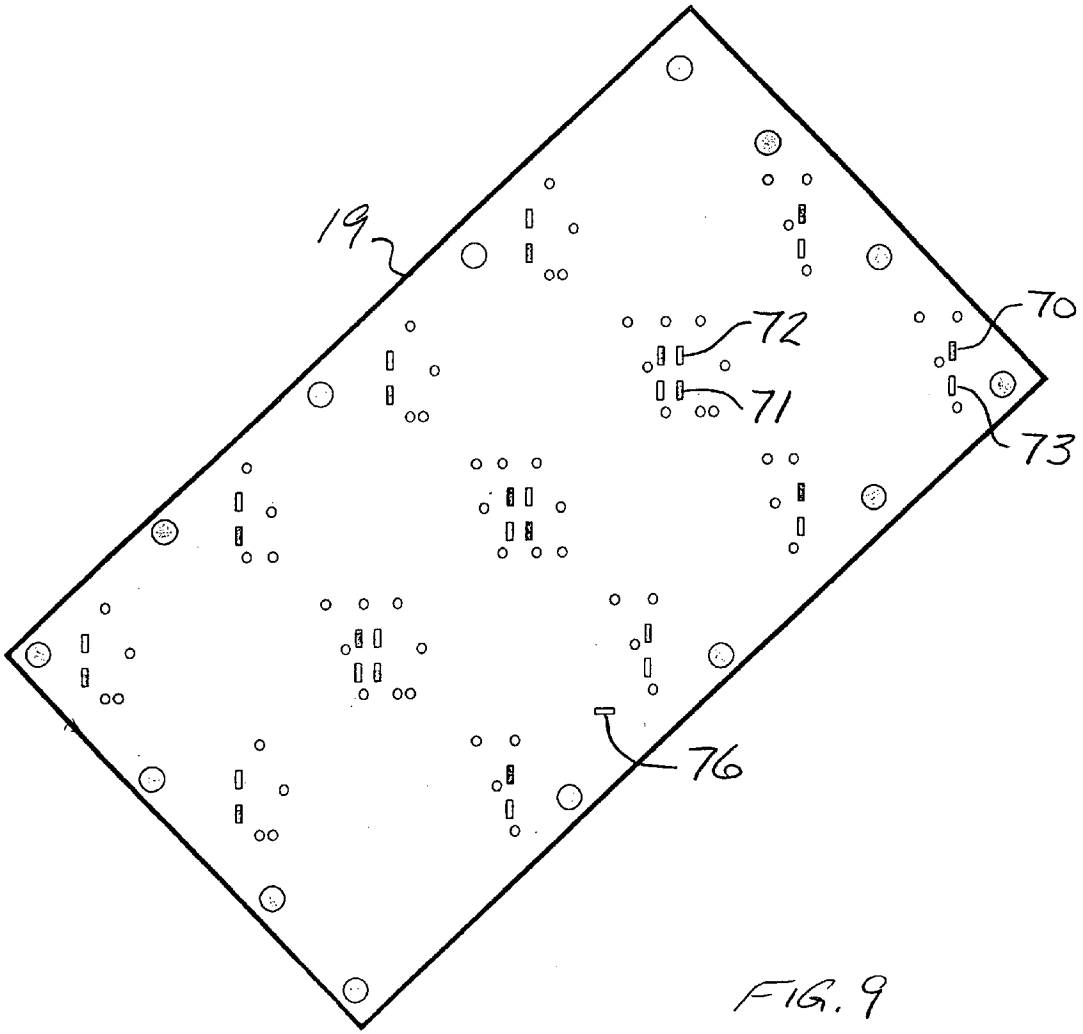

Ninth layer 19, as shown in FIG. 9 has openings forming extensions (e.g., normal waveguide extensions 70 and 71) of third normal waveguide sections (e.g., of sections 42 and 43 as extended by extensions, 60 and 61 respectively) and extensions (e.g., normal waveguide extensions 72 and 73) of fourth normal waveguide sections (e.g., of sections 44 and 45 as extended by extensions 62 and 63, respectively) of layers 17 and 18. Ninth layer 19 further includes an opening forming a sixth normal waveguide section 76 coupled to the common feed point 68 of the eighth layer 18.

Figure 10:
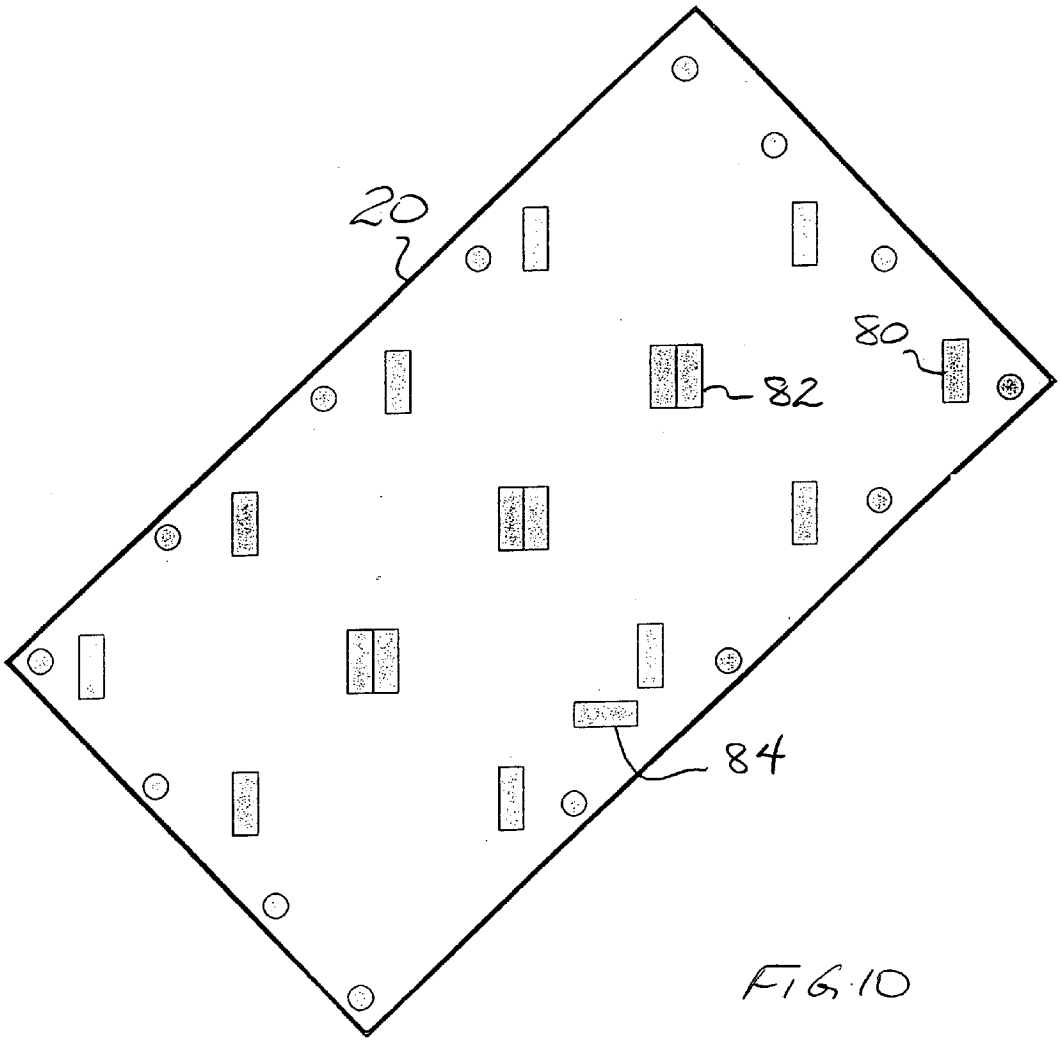
FIG. 10 shows a support layer which may comprise a printed circuit board positioned below the nine conductive layers of the FIG. 1 antenna to support signal processing units coupled to the waveguide sections.

The flat-plate antenna of FIG. 1 may further include a support layer 20 as shown in FIG. 10. Support layer 20 may be configured to provide physical support for signal processing units and provide signal coupling access to the third and fourth normal waveguide extensions (e.g., extensions 70–73) of layer 19 (e.g., for coupling of signal processing units for signal amplification or other signal processing purposes). Signal coupling access to the waveguide extensions of layer 19 (e.g., extensions 70–73) may be provided via openings such as openings 80 and 82, which may effectively be clearance openings arranged to accommodate signal coupling between signal processing units mounted on the support layer 20 and the waveguide extensions. Also, an opening such as opening 84 may be provided in an appropriate configuration to enable a signal port (e.g., a coaxial connector) which may be supported on layer 20 to be coupled to common feed point 68 of layer 18 via sixth normal waveguide section 76 of layer 19. Signal coupling via the openings, such as 80, 82, 84, in layer 20 to the waveguide sections of layer 19 (e.g., sections 70–73 and 76)

may be made via a suitable coupling probe, stub or conductor positioned in conjunction with the waveguide opening and connected to the signal port or a signal processing unit.

While the preceding description has particularly focused on the normal and transverse waveguide sections of layers 11–19 which are effective to couple signals to and from the radiating slot elements of sub-array 26 of FIG. 1, it will be appreciated that other combinations of the waveguide sections of layers 11–19 are arranged to provide essentially parallel processing of signals with respect to the other fifteen sub-arrays of slot elements of the FIG. 1 antenna. Thus, antenna 10 of FIG. 1 provides both radiating elements and a signal processing network for the 256 slot elements in the form of a composite assembly of nine layers which may have a thickness of about one-half inch, or a thickness of about an inch and one-quarter when a polarizer, support layer and signal processing units are added.

Figure 11:
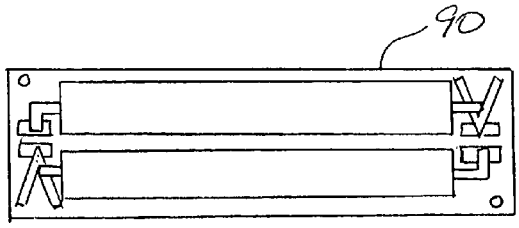
FIG. 11 shows a form of signal processing unit usable with the FIG. 1 antenna to provide amplification, phase shifting, or both.

FIG. 11 is a simplified plan view of a signal processing unit 90 suitable for use with the FIG. 1 antenna. As shown, unit 90 is configured for mounting to the lower surface of support layer 20 of FIG. 10 and may be positioned over and extending between openings 80 and 82. Unit 90 may comprise a low noise amplifier, a power amplifier, as well as phase shifters and other elements as suitable to provide signal processing functions during signal reception or signal transmission, or both, utilizing known antenna techniques to provide beam pointing or scanning or other antenna capabilities. As represented at the ends of unit 90 in FIG. 11, it may include signal coupling probes, stubs or conductors suitable for coupling signals to or from the normal waveguide extensions 70, 71, 72, 73 of layer 19, which are accessible via the openings 80 and 82 of layer 20. In this construction, layer 20 may be a form of printed circuit board configured to mechanically support signal processing unit 90 (and seven additional such units for the complete antenna) and provide electrical supply power and other connections to unit 90 for the operation thereof.

Figure 12:
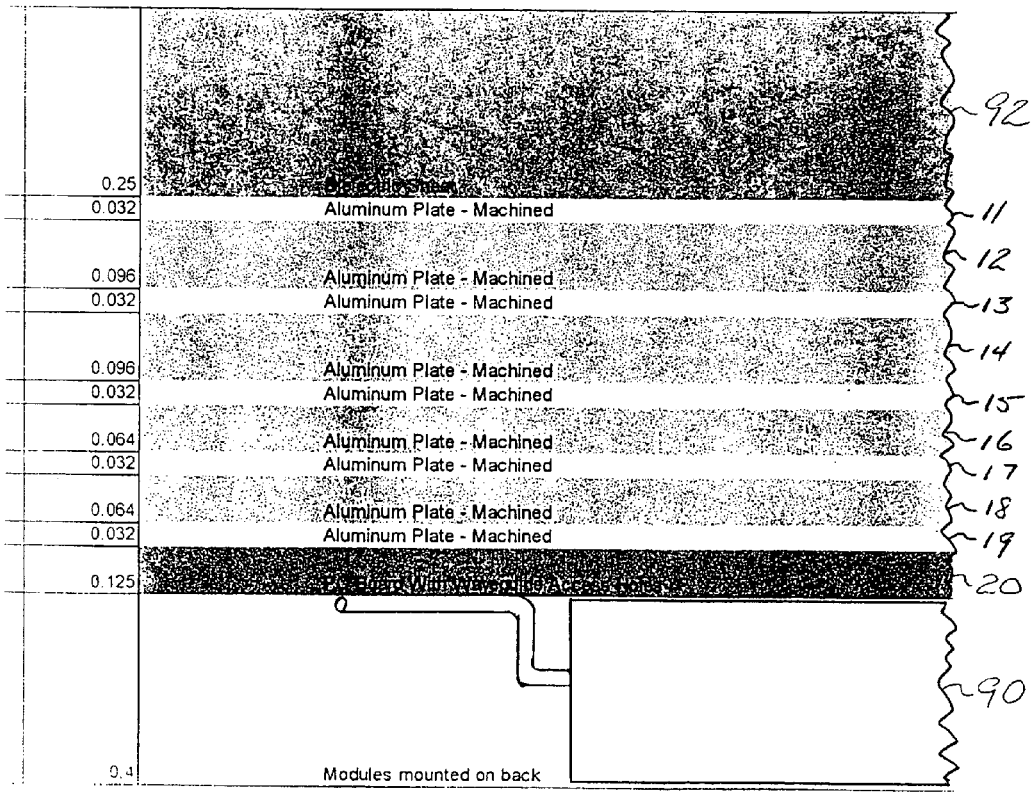
FIG. 12 is a representation of a cross-sectional view of the FIG. 1 antenna which, with inclusion of a top polarizer sheet and signal processing units at the bottom, may have an overall thickness of the order of one and one-quarter inches.

FIG. 12 is a simplified cross-sectional enlarged view of a small portion of a complete antenna utilizing layers 11–20 as described above. This view illustrates one example of the overall thickness and relative individual layer thicknesses. As shown, the cross section does not pass through any of the waveguide openings discussed above.

The antenna as represented in cross section includes layers 11–20 of FIGS. 1–10, with a dielectric polarizer sheet 92 one-quarter inch thick overlaying the surface of the slot element sheet 11 and a signal processing unit 90 of 0.4 inch thickness supported on the lower surface of a printed circuit board forming layer 20. In this example, layers 11–19 may be provided in the form of stacked sections of aluminum plate or sheet which have been machined or otherwise formed to provide the respective openings as shown in and described with reference to layers 11–19 of FIGS. 1–9.

In the embodiment represented in FIG. 12, the layers comprise sections of machined aluminum plate of the following thicknesses; layers 11, 13, 15, 17 and 19, thickness of 0.032 inches; layers 12 and 14, thickness of 0.096 inches; layers 16 and 18, thickness of 0.064 inches. With this construction the stack of layers 11–19 have an overall thickness of 0.48 inches and, with polarizer layer 92 and 0.4 inch accommodation for signal processing unit 90, the overall antenna thichness as illustrated is only 1.255 inches. Thus, a flat plate antenna is provided, with incorporation of a polarizer layer, a signal combining/dividing network and associated signal processing units, in a physical construction of reduced overall thickness (e.g., about one and one-quarter inches) and appropriate for use in a variety of applications, including size and weight limited moving vehicle applications.

Figure 13:
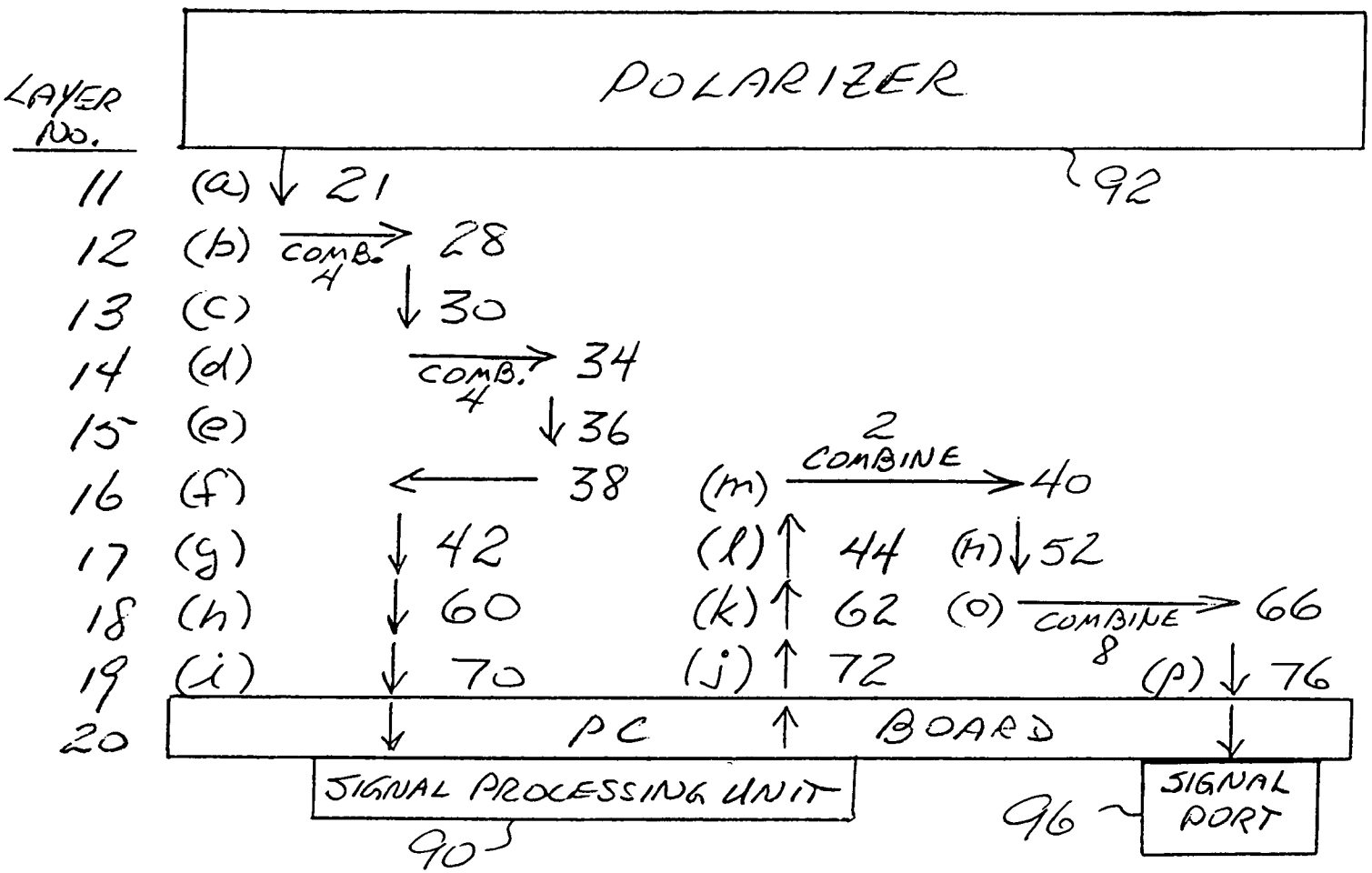
FIG. 13 is a form of signal flow diagram providing a simplified overview of folded path signal processing employed in the FIG. 1 antenna in accordance with the invention.

Referring now to FIG. 13, there is shown a simplified form of signal flow diagram for representative signals received via slot element 21 of layer 11 and coupled to waveguide section 76 of layer 19, which may be coupled to an input/output signal port mounted on layer 20.

Layers 11–20 of FIGS. 1–10 are referenced at the left of FIG. 13. Identifiers (a) through (p) identify passage of the received signals through a series of normal and transverse waveguide sections whose reference numbers appear to the right of the identifiers (a)–(p). The reference numbers are the reference numbers discussed above for normal and transverse waveguide sections provided within layers 11–19. The polarizer plate is represented at 92 and a signal processing unit 90 and signal port (e.g., coaxial connector) 96 are also included.

Assume a signal received and changed from incident circular to linear polarization is coupled to slot radiating element 21 of FIG. 1. The coupling of the signal through slot 21 from layer 11 to layer 12 is represented at (a).

At (b) the signal is combined with signals from slot elements 22, 23, 24 in first transverse waveguide section 28 of layer 12 and coupled to layer 13.

At (c) the signal is coupled through layer 13 to layer 14 via first normal waveguide section 30.

At (d) the signal is combined with signals from other first normal waveguide sections 31, 32, 33 in second transverse waveguide section 34 of layer 14 and coupled to layer 15.

At (e) the composite signal is coupled through layer 15 to layer 16 via second normal waveguide section 36.

At (f) the composite signal is coupled through layer 16 to layer 17 via third transverse waveguide section 38 for the purpose of alignment with in/out ports of a signal processing unit 90.

At (g) the composite signal is coupled through layer 17 to layer 18 via third normal waveguide section 42.

At (h) the composite signal is coupled through layer 18 to layer 19 via waveguide extension 60.

At (i) the composite signal is coupled, via waveguide extension 70, through layer 19 to signal processing unit 90 (e.g., a low noise amplifier and phase shifter) on layer 20.

At (j) the processed signal is coupled, via waveguide extension 72, from signal processing unit 90 (e.g., after amplification and phase shift) upward through layer 19 to layer 18.

At (k) the processed signal is coupled upward through layer 18 to layer 17 via waveguide extension 62.

At (l) the processed signal is coupled upward through layer 17 to layer 16 via fifth normal waveguide section 44.

At (m) the processed signal (representing combined signals from the sixteen slot elements of sub-array 16) is combined with a second processed signal (representing a signal received via the sub-array to the left of sub-array 26 in FIG. 1) via fourth transverse waveguide section 40 and coupled to layer 17.

At (n) the combined two sub-array processed signal is coupled downward through layer 17 to layer 18 via fifth normal waveguide section 52.

At (o) the combined two sub-array processed signal is combined with processed signals from pairs of all of the other sub-arrays of layer 11 of FIG. 1 via fifth transverse waveguide configuration 66 and coupled to common feed point 68.

At (p) the combined sixteen sub-array processed signal is coupled, via sixth normal waveguide section 76, downward from common feed point 68 through layer 19 to signal port 96 positioned on layer 20.

Thus, pursuant to the invention, signals received via the 256 slot elements of layer 11 in FIG. 1, can be combined on a sub-array basis, processed, combined into a single composite signal and made available at an input/output port with active and passive antenna elements included in a single structural arrangement of reduced thickness. As will be understood by skilled persons, reciprocity principles apply and for signal transmission a signal to be radiated can be supplied to the input/output port for provision of component signals to all 256 slot radiating elements, with suitable amplification, phase shift and other desired processing provided on a sub-array by sub-array basis.

In view of the preceding discussion of antenna 10 of FIG. 1 and its operation, a method for use with an antenna (e.g., the antenna of FIG. 1 or other suitable antenna) will be described. More particularly, a method for use with an antenna including a stack of conductive layers each formed with openings usable as waveguide section portions, the layers stacked in a normal dimension with transverse dimensions parallel to the face of the stack, may comprise the steps of:

(a) coupling received signals in a first normal direction, via a first set of selected openings (70, 71) in at least one of said layers, to a signal processing unit (90) adjacent to said stack to provide processed signals;

(b) coupling said processed signals in a reverse normal direction, via a second set of selected openings (72, 73) in at least one of said layers, away from said signal processing unit (90) to a selected layer within said stack;

(c) coupling said processed signals in a transverse direction, via an opening forming a transverse waveguide section (66) in said selected layer, said transverse waveguide section arranged to combine said processed signals with additional processed signals to provide combined signals; and (d) coupling said combined signals again in said first normal direction, via at least one third selected opening (76) in at least one of said layers, to a signal port (96).

Further to the above method, in step (a) the received signals may be coupled to a signal processing unit comprising an amplifier, a phase shifter, or both.

A method in accordance with the invention may additionally comprise the step of:

(e) supporting a signal processing unit and an antenna port on a printed circuit board positioned adjacent to the stack of conductive layers.

Such a method may also comprise, prior to step (a), the step of:

(x) receiving signals via a configuration of slot radiating elements arranged to enable received signals to be coupled to the first set of selected openings.

With an understanding of the invention, it will be apparent that, on a sub-combination basis, an antenna may be characterized as comprising a sub-set of layers, such as layers 15, 16, 17, 18, 19, for example. Thus, an antenna, having conductive layers stacked in a normal dimension, with transverse dimensions parallel to the face of the stack, may comprise:

a layer (15) having openings forming first waveguide sections (36, 37) each arranged to couple received signals;

a layer (16) having openings forming second waveguide section (38, 39) and a transverse waveguide section (40), each second waveguide section coupled to one of the first waveguide sections (36, 37);

a layer (17) having openings forming third (42, 43), fourth (44, 45) and fifth (52) normal waveguide sections, each third normal waveguide section (42, 43) coupled to a second waveguide section (38,39) and each fourth and fifth normal waveguide section (44, 45, 52) coupled to a fourth transverse waveguide section (40); and a layer (18) having openings forming extensions (60, 61) of the third normal waveguide sections and extensions (62, 63) of the fourth normal waveguide sections and forming a transverse waveguide section (66) coupling the fifth normal waveguide sections (51–58) to a common feed point (68).

As will be seen, for purposes of description of this antenna on a sub-set basis different identifying nomenclature has been assigned to certain waveguide sections than was used in description of the full ten layer antenna as addressed above, the particular nomenclature being a matter of choice for descriptive purposes.

While there have been described the currently preferred embodiments of the invention, those skilled in the art will recognize that other and further modifications may be made without departing from the invention and it is intended to claim all modifications and variations as fall within the scope of the invention.

What is claimed is:

1. A flat-plate antenna, having nine conductive layers stacked in a normal dimension with transverse dimensions parallel to the face of the stack, comprising:

a first layer (11) having openings forming slot radiating elements arranged in groups (21, 22, 23, 24), said groups arranged in a plurality of sub-arrays (26);

a second layer (12) having openings forming first transverse waveguide sections (28) extending in parallel in a first transverse direction and each coupled to a group of the radiating elements (21, 22, 23, 24);

a third layer (13) having openings forming first normal waveguide sections (30, 31, 32, 33) each coupled to one of the first transverse waveguide sections (28);

a fourth layer (14) having openings forming second transverse waveguide sections (34) extending in parallel in a second transverse direction and each coupled to a plurality of the first normal waveguide sections (30, 31, 32, 33) and thereby coupled to each radiating element of one of the sub-arrays (26);

a fifth layer (15) having openings forming second normal waveguide sections (36, 37) each coupled to one of the second transverse waveguide sections (34, 35);

a sixth layer (16) having openings forming third (38, 39) and fourth (40) transverse waveguide sections, each said third transverse waveguide section coupled to one of said second normal waveguide sections (36, 37);

a seventh layer (17) having openings forming third (42, 43), fourth (44, 45) and fifth (52) normal waveguide sections, each said third normal waveguide section (42, 43) coupled to a third transverse waveguide section (38, 39) and each said fourth and fifth normal waveguide section (44, 45, 52) coupled to a fourth transverse waveguide section (40);

an eighth layer (18) having openings forming extensions (60, 61) of said third normal waveguide sections and extensions (62, 63) of said fourth normal waveguide sections, and forming a fifth transverse waveguide section (66) coupling said fifth normal waveguide sections (51–58) to a common feed point (68);

a ninth layer (19) having openings forming extensions (70, 71) of said third normal waveguide sections and extensions (72, 73) of said fourth normal waveguide sections, and forming sixth normal waveguide section (76) coupled to said common feed point (68); and a support layer (20) suitable to support at least one signal processing unit with coupling access to said third and fourth normal waveguide section extensions (70–73) and to support an antenna port with coupling access to said sixth normal waveguide section (76).

2. A flat-plate antenna as in claim 1, wherein said first layer (11) includes groups of slot radiating elements arranged in a rectangular type array of 16 sub-arrays.

3. A flat-plate antenna as in claim 2, wherein said fourth transverse waveguide section (40) of the sixth layer (16) is arranged to additively combine signals received by two of said sub-arrays and said fifth transverse waveguide section (66) of the eighth layer (18) is arranged to additively combine signals from all 16 of said sub-arrays.

4. A flat-plate antenna as in claim 1, additionally comprising:

signal processing units supported by said support layer and coupled to said third and fourth normal waveguide extensions (70–73), said signal processing units comprising at least one of amplifiers and phase shifters.

5. A flat-plate antenna as in claim 1, wherein said support layer comprises a printed circuit board.

6. An antenna, having conductive layers stacked in a normal dimension with transverse dimensions parallel to the face of the stack, comprising:

a top layer having openings forming slot radiating elements arranged in a plurality of sub-arrays;

a plurality of intermediate layers;

a bottom layer having openings forming waveguide sections;

at least a first signal processing unit coupled to at least one of said waveguide sections; and a signal port;

said intermediate layers having openings forming waveguide sections arranged to:

(i) couple signals received via a first sub-array of said slot elements through selected ones of said waveguide sections to said first signal processing unit;

(ii) couple processed signals away from said first signal processing unit through selected ones of said waveguide sections;

(iii) combine said processed signals with processed signals from at least a second sub-array of said slot elements to provide combined signals; and (iv) couple said combined signals through selected ones of said waveguide sections to said signal port.

7. An antenna as in claim 6, wherein said signal processing unit is at least one of an amplifier and a phase shifter.

8. An antenna as in claim 6, wherein said at least one signal processing unit and said signal port are positioned adjacently below said bottom layer.

9. An antenna as in claim 6, wherein said at least a first signal processing unit comprises one separate signal processing unit for each sub-array of said plurality of sub-arrays.

10. An antenna as in claim 6, wherein said openings in said intermediate layers form normal waveguide sections each arranged to couple signals in a normal direction and transverse waveguide sections each arranged to couple signals in a transverse direction.

11. An antenna as in claim 10, wherein said transverse waveguide sections include waveguide sections arranged to combine a plurality of signals.

12. An antenna as in claim 6, wherein the antenna is arranged for reciprocal operation for signal transmission with items (i), (ii), (iii) and (iv) in opposite order with a signal input at said signal port divided, processed and coupled in respective portions to each slot element of each of said plurality of sub-arrays.

13. An antenna, having conductive layers stacked in a normal dimension with transverse dimensions parallel to the face of the stack, comprising:

a layer (15) having openings forming first waveguide sections (36, 37) each arranged to couple received signals;

a layer (16) having openings forming second waveguide sections (38, 39) and a transverse waveguide section (40), each said second waveguide section coupled to one of said first waveguide sections (36, 37);

a layer (17) having openings forming third (42, 43), fourth (44, 45) and fifth (52) normal waveguide sections, each said third normal waveguide section (42, 43) coupled to a second waveguide section (38, 39) and each said fourth and fifth normal waveguide section (44, 45, 52) coupled to a fourth transverse waveguide section (40); and a layer (18) having openings forming extensions (60, 61) of said third normal waveguide sections and extensions (62, 63) of said fourth normal waveguide sections, and forming a transverse waveguide section (66) coupling said fifth normal waveguide sections (51–58) to a common feed point (68).

14. An antenna as in claim 13, further comprising:

a support layer to support at least one signal processing unit with coupling access to said waveguide section extensions (60–63) and to support a signal port with coupling access to said common feed point (68).

15. An antenna as in claim 13, additionally comprising:

signal processing units supported by said support layer and coupled to said waveguide extensions (60–63), said signal processing units comprising at least one of amplifiers and phase shifters.

16. An antenna, having conductive layers stacked in a normal dimension with transverse dimensions parallel to the face of the stack, comprising:

at least one layer (17, 18, 19) having a first opening (42, 60, 70) forming a waveguide section arranged to couple received signals in a first normal direction for coupling to a signal processing unit adjacent to said stack;

at least one layer (19, 18, 17) having a second opening (72, 62, 44) forming a waveguide section arranged to couple processed signals away from said signal processing unit in a reverse normal direction;

at least one layer (16) having a third opening (40) forming a transverse waveguide section arranged to couple signals in a transverse direction to combine said processed signals with other processed signals to provide combined signals; and at least one layer (17, 18, 19) having a fourth opening (52, 76) forming a waveguide section arranged to couple said combined signals in said first normal direction for coupling to an antenna port;

wherein at least one said layer includes more than one of said first, second, third and fourth openings.

17. An antenna as in claim 16, additionally comprising:

a signal processing unit positioned adjacent to said layers and responsive to received signals coupled via a said first opening to provide processed signals to a said second opening.

18. An antenna as in claim 17, wherein said signal processing unit comprises at least one of an amplifier and a phase shifter.

19. An antenna as in claim 16, additionally comprising:

a configuration of slot radiating elements arranged to enable received signals to be coupled to a said first opening.

20. A method, for use with an antenna including a stack of conductive layers each formed with openings usable as waveguide sections, the layers stacked in a normal dimension with transverse dimensions parallel to the face of the stack, the method comprising the steps of:

(a) coupling received signals in a first normal direction, via a first set of selected openings in a least one of said layers, to a signal processing unit adjacent to said stack to provide processed signals;

(b) coupling said processed signals in a reverse normal direction, via a second set of selected openings in at least one of said layers, from said signal processing unit to a selected layer within said stack;

(c) coupling said processed signals in a transverse direction, via an opening forming a transverse waveguide section in said selected layer, said transverse waveguide section arranged to combine said processed signals with additional processed signals to provide combined signals; and (d) coupling said combined signals in said first normal direction, via a third set of selected openings in at least one of said layers, to a signal port.

21. A method as in claim 20, wherein in step (a) the received signals are coupled to a signal processing unit comprising an amplifier.

22. A method as in claim 20, wherein in step (a) the received signals are coupled to a signal processing unit comprising a phase shifter.

23. A method as in claim 20, additionally comprising the step of:

(e) supporting said signal processing unit and said signal port on a printed circuit board positioned adjacent to said stack of conductive layers.

24. A method as in claim 20, additionally comprising, prior to step (a), the step of:

(x) receiving signals via a configuration of slot radiating elements arranged to enable received signals to be coupled to said first set of selected openings.

* * * * *